United States Patent [19]

Rosen et al.

[11] 4,072,314

[45] Feb. 7, 1978

[54] SOUND-PRODUCING MIRROR TOY

[75] Inventors: Beverly Rosen, East Brunswick; Sidney A. Tepper, Millburn, both of N.J.

[73] Assignee: Lasco Toys International Inc., East Brunswick, N.J.

[21] Appl. No.: 709,063

[22] Filed: July 27, 1976

[51] Int. Cl.[2] ..... A63F 9/18

[52] U.S. Cl. ..... 273/161; 40/455; 46/1 R; 46/175 AR; 46/227; 272/8 M; 273/138 A

[58] Field of Search ..... 273/161, 138 A; 240/2 L, 4.1, 4.2; 46/227, 232, 175 AR; 40/28 B; 272/8 M

[56] References Cited

U.S. PATENT DOCUMENTS

| | | | |
|---|---|---|---|
| 2,221,888 | 11/1940 | White | 40/28 B UX |
| 2,483,901 | 10/1949 | Harris | 272/8 M |
| 3,655,325 | 4/1972 | Toppel | 35/22 R UX |
| 3,798,833 | 3/1974 | Campbell | 46/227 |

*Primary Examiner*—Anton O. Oechsle
*Attorney, Agent, or Firm*—Alan H. Levine

[57] ABSTRACT

A toy including a mirror of the type which reflects light from its front surface when there is darkness behind it and which becomes transparent when there is light behind it. A representation, such as of a face, is behind the mirror as is a light source. An electrical sound-producing mechanism is associated with the mirror. The light source is normally deenergized and the sound-producing mechanism inoperative. A switch is provided for simultaneously energizing the light source and for actuating the sound-producing means.

11 Claims, 10 Drawing Figures

FIG. 3
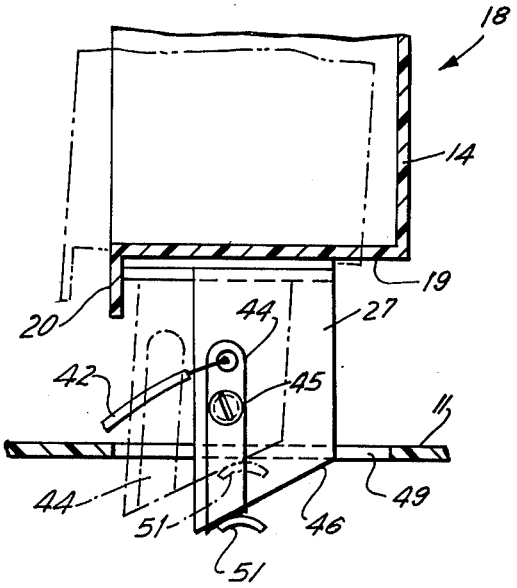
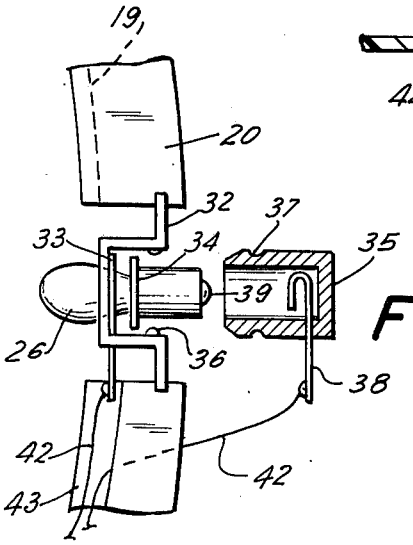
FIG. 6
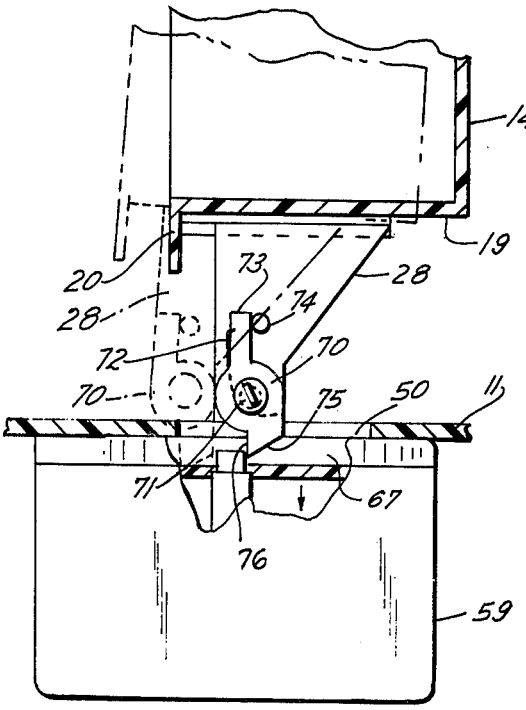
FIG. 5

SOUND-PRODUCING MIRROR TOY

This invention relates to toys, and more particularly to a toy intended to be the physical embodiment of the "magic mirror" described in the popular fairy tale "Snow White." In that story, when one stands in front of the magic mirror and asks "Mirror, mirror on the wall, who is the fairest one of all?", a face miraculously appears in the mirror and answers with the name of the fairest maiden in the land.

It is an object of the present invention to provide a toy which in one condition is a mirror, and wherein by means of a simple movement a representation, such as of a face, appears behind the mirror and simultaneously a sound, preferably a spoken message, is produced.

It is another object of the invention to provide such a toy capable of producing a plurality of spoken messages, and wherein a single randomly-selected message is produced in response to each movement.

It is a further object of the invention to provide such a toy wherein the movement used to illuminate the representation and initate the spoken message is a movement of the mirror. A feature of the invention involves means for automatically returning the mirror to its original position after the mirror has been moved and is released. This return means may be part of the switch means which turns on the light to illuminate the representation.

An additional object of the invention is the provision of a housing for accommodating the representation and an electric light bulb, the arrangement being such that the bulb can be replaced without opening the housing.

Another object of the invention is the provision of an actuator means movable with the mirror and a talking mechanism having a push button, for initiating operation, arranged in the path of movement of the actuator means, the actuator means depressing the push button when it moves in one direction past the button but leaving the push button unactuated when the actuator means returns in the opposite direction.

Additional objects and features of the invention will be apparent from the following description in which reference is made to the accompanying drawings.

In the drawings:

FIG. 3 is a fragmentary vertical cross-sectional view along line 3—3 of FIG. 2;

FIG. 5 is a fragmentary vertical cross-sectional view taken along line 5—5 of FIG. 2; and FIG. 6 is an exploded detail view, or an enlarged scale, of the light bulb and its holder.

Figure 1:
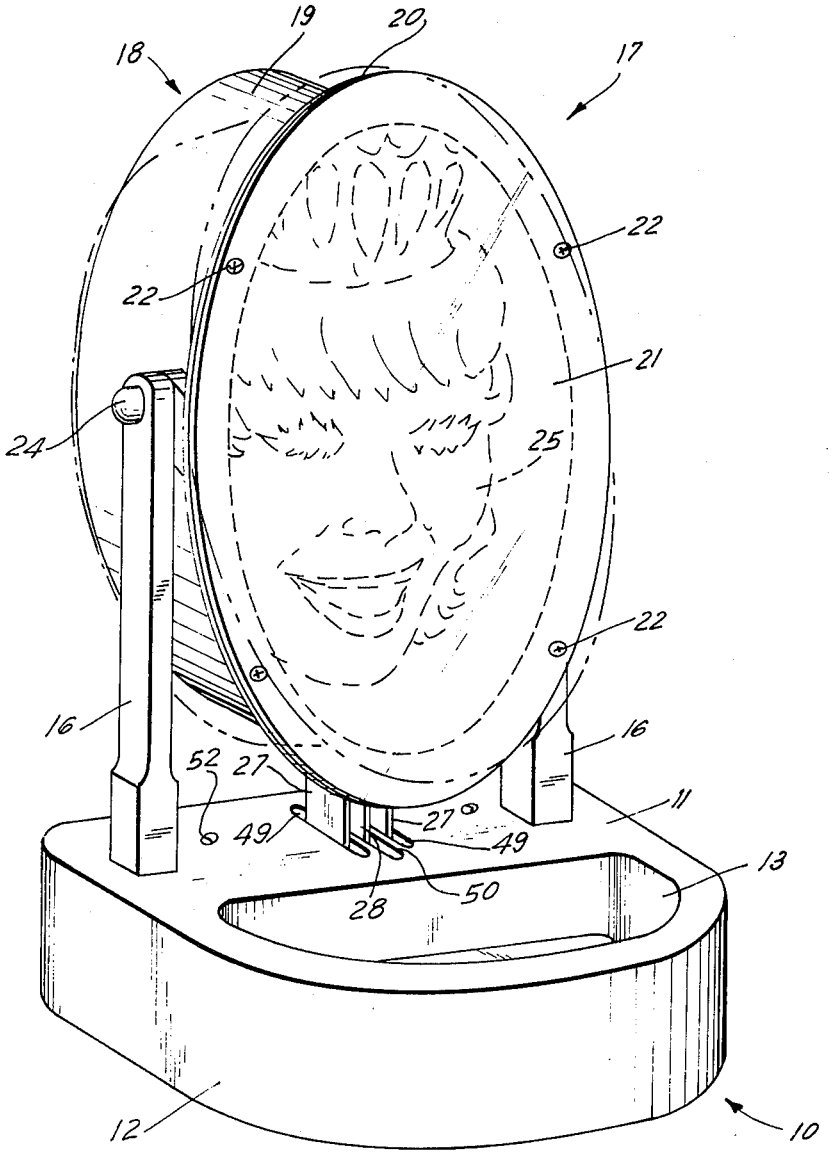
FIG. 1 is a perspective view of a sound-producing mirror toy according to the present invention.

The sound-producing mirror toy chosen to illustrate the present invention includes a hollow base 10 having a top wall 11 and side wall 12. The top wall is formed toward the front of the base with a depression 13 defining a tray in which, for example, play cosmetics, hair pins, and decorative hair ornaments may be stored. The entire base, including top wall 11, side wall 12, and tray 13 may be formed of a single piece of molded plastic.

At its rear, top wall 11 is formed with two sockets 15 (see FIG. 4) within which the lower ends of two upstanding posts 16 are firmly supported. Pivotally mounted between the upper ends of posts 16 is a mirror assembly 17.

Mirror assembly 17 includes a housing 18 having a back wall 14 (FIGS. 3 and 5) and a side wall 19, the front edge of the side wall terminating in an outwardly projecting flange 20. The back wall 14, side wall 19, and flange 20 may be formed of a single piece of molded plastic. The front of housing 18 is closed by a mirror 21 fixed to flange 20 by suitable fastening means, such as screws 22. The mirror is planar so that it faithfully reflects the image of a person looking at it. Mirror 21 is of the type which reflects light from its front face when there is darkness behind it, i.e., when there is no light within housing 18, and which becomes transparent when the interior of the housing is illuminated. Such a mirror may be made of a thin sheet of transparent plastic, such as polystyrene, having a vacuum metalized coating on one of its surfaces.

Figure 2:
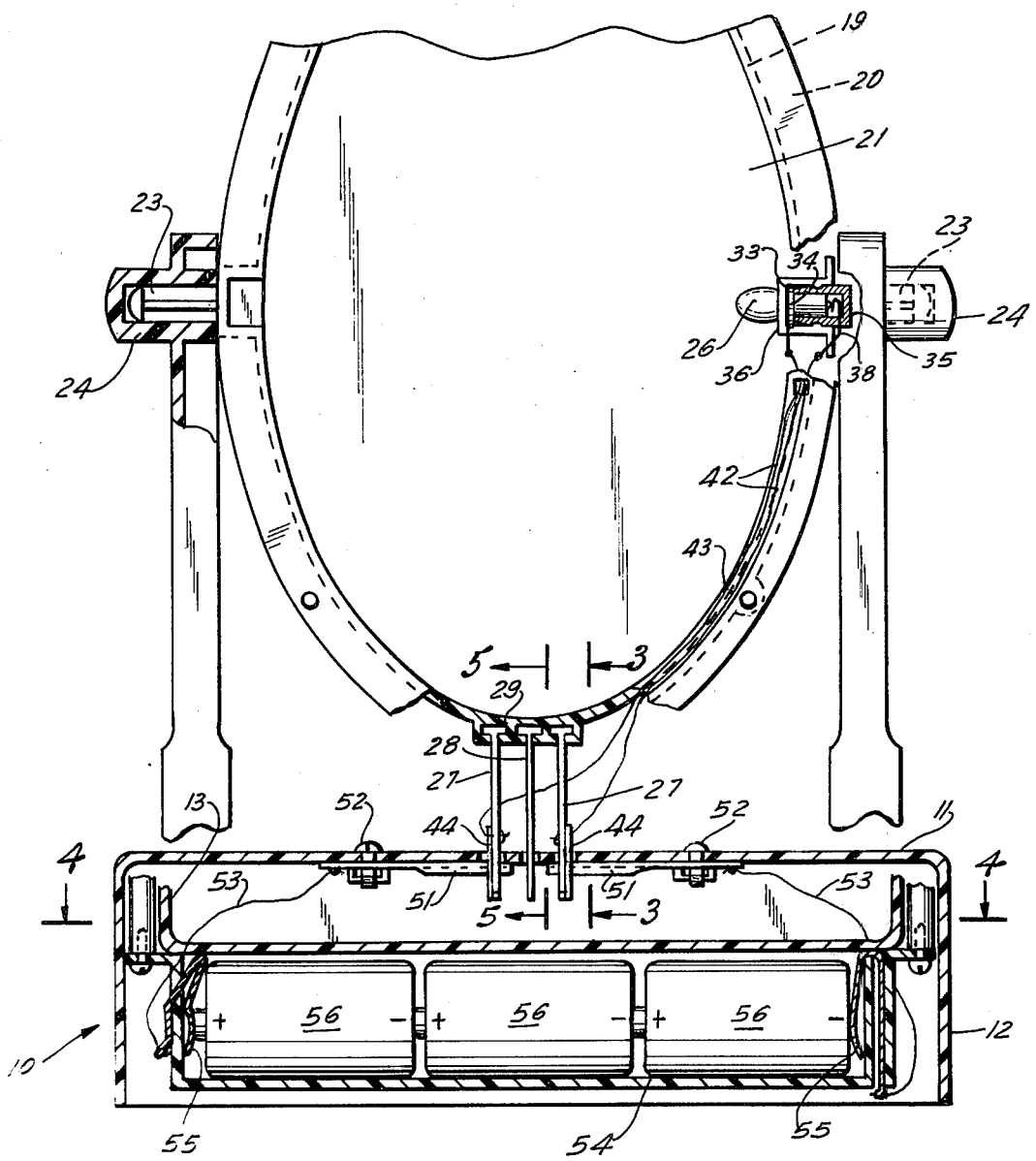
FIG. 2 shows the mirror and posts which support it in front elevation, with parts broken away, and a vertical cross-section through the base.

Projecting outwardly from two opposite points of side wall 19 are two pivot pins 23 (FIG. 2). Each pin has a cross-shaped cross-section, for ease of molding, and a semicircular end. Each pin is rotatably supported within a socket 24 carried by each post 16 near its upper end.

Within housing 18 is a representation of some sort which is to be seen through mirror 21 when the inside of the housing is illuminated. In this example, the representation is a three dimensional replica of a face 25, intended to represent the face in the magic mirror which answers the question about the fairest one in the land. Also within housing 18 is an electric light bulb 26, preferably of the type used in a flashlight.

Depending from the bottom of housing side wall 19 are three plate-like arms 27 and 28 (FIGS. 1 and 2). A convenient way of mounting these arms on the housing involves providing the side wall 19 with a thickened region 29 within which are three T-shaped slots, and providing each of the arms 27, 28 with a flange along its top edge. The flange and top portion of each arm is then inserted into one of the T-shaped slots to assemble the arm with the housing.

Near one of the sockets 24, housing side wall 19 is formed with an opening within which a light bulb holder 32 (FIGS. 2 and 6) is mounted. A metal contact tab 33 is arranged within the holder 32, the tab having a hole in it aligned with a hole in holder 32. The glass enclosure of bulb 26 passes through both holes, and a metal flange 34, which is one terminal of the bulb, engages contact tab 33. A cap 35 fits over the rear end of bulb 26, the cap being held in place by protuberances 36 on holder 32 snapping into an annular groove 37 in cap 35. A springy metallic contact 38 in the rear part of cap 35 engages the other terminal 39 of the bulb 26, a part of contact 38 extending through a hole in cap 35 to the exterior of the cap. The resilience of contact 38 presses flange 34 against contact tab 33. When bulb 26 is to be replaced, cap 35 is snapped out of holder 32, the bulb removed and replaced, and the cap snapped back into the holder. It is not necessary to open housing 18 to accomplish this replacement.

Contacts 33 and 38 are connected by wires 42, fitted within a groove 43 in flange 20, to two contacts 44, respectively (FIGS. 2 and 3), each of which is secured to one of the arms 27 by a fastener, such as a screw 45. Each contact 44 is L-shaped so that it extends over the lower edge 46 of its respective arm 27, edge 46 being inclined as shown in FIG. 3.

Arms 27 and 28 extend through three parallel slots 49 and 50, respectively, in base top wall 11. Extending beneath each slot 49, within base 10, is one end of a springy metallic contact 51 (FIGS. 2 and 3), the other end of each contact being fixed to the under surface of top wall 11 by screws 52. Contacts 51 are connected by wires 53 to springy metallic contacts 55 located at opposite ends of a battery housing 54 within base 10 beneath tray 13. Three aligned flashlight batteries 56 within battery housing 54 engage contacts 55. Each contact 44, on arm 27, and its associated contact 51 constitutes a switch which closes when contacts 44 and 51 engage each other and opens when contacts 44 and 51 are separated. When these two switches are closed, batteries 56 are electrically connected to light bulb 26 which is thereby energized and illuminates the face 25 within housing 18. When the switches are open, the interior of housing 18 is dark.

When housing 18 is in its normal position, shown in broken lines in FIGS. 1 and 3, the inclined lower edge 46 of each arm 27 engages its respective contact 51, but the contact 44 carried by that arm is separated from contact 51. Hence light bulb 26 is off. If housing 18 is pivoted so that its lower portion moves rearwardly, into the solid line position of FIGS. 1 and 3, each contact 44 is brought into engagement with its respective contact 51 so that bulb 26 is turned on. During this movement, the inclined edge 46 bends contact 51 downwardly stressing the contact. This serves to insure good contact between contacts 44 and 51. In addition, when housing 18 is released, contacts 51 pushing upwardly on inclined surfaces 46 cause housing 18 to be pivoted back to its normal position. If desired, an additional spring (not shown) may be employed to return housing 18 to its normal position.

Figure 4:
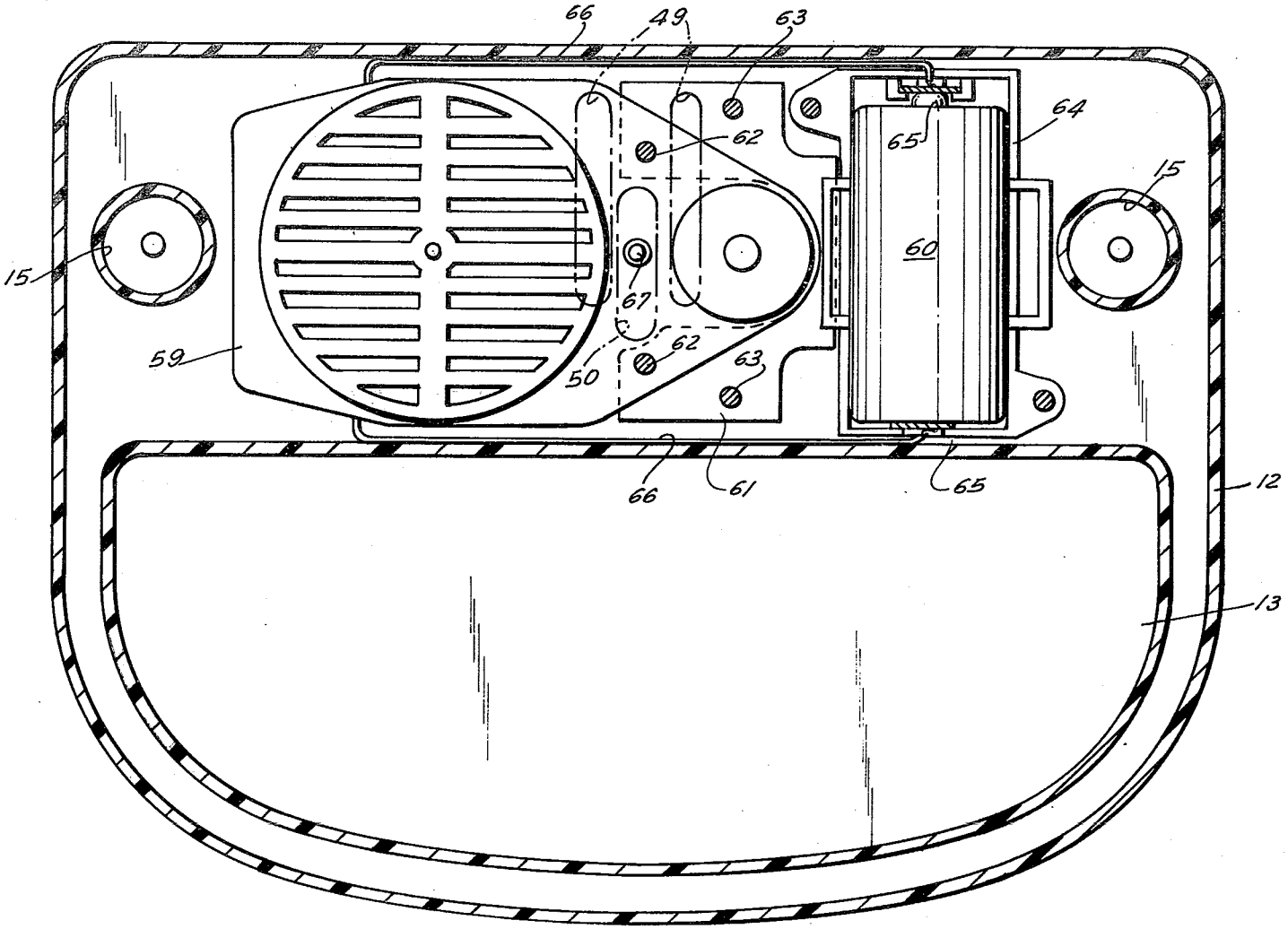
FIG. 4 is a horizontal cross-sectional view, on an enlarged scale, taken along line 4—4 of FIG. 2.

Within base 10, beneath the rear portion of top wall 11, is a talking mechanism 59 and a battery 60 (FIGS. 4 and 5). Talking mechanism 59 is fixed to a bracket 61 by screws 62, the bracket being fixed to base 10 by screws 63. Battery 60 is located within a battery housing 64, its ends engaging contacts 65 within the housing. Contacts 65 are connected by wires 66 to talking mechanism 59.

The talking mechanism is preferably of a well-known type including a motor-driven turntable carrying a phonograph record of special character. The record is formed with a plurality, say six, of interleaved unconnected spiral grooves, each groove carrying a different spoken message. A stylus is provided for engaging the grooves and reproducing the spoken messages through a speaker. When an actuator push button 67 on the exterior of the talking mechanism is depressed, a switch is closed to energize the motor and rotate the turntable. The stylus engages one of the record grooves and reproduces the message in that groove. When the stylus reaches the end of the groove, the switch for energizing the motor is opened and the stylus automatically returned to the beginning of one of the grooves. The particular groove engaged by the stylus is entirely random; it could engage the beginning of the same groove just played, or any of the other grooves, but in no particular order. The talking mechanism does not operate again until push button 67 is again depressed.

Push button 67 is located directly beneath slot 50 in base top wall 11, through which arm 28 extends. Arm 28 forms part of an actuator means for push button 67, the actuator means also including a pawl 70 pivotally secured to arm 28 by a pivot pin 71. A spring 72 constantly urges pawl 70 in a clockwise direction in FIG. 5 so that an upwardly projecting finger 73 of the pawl abuts a stop carried by arm 28. The lower edge 75 of pawl 70 has an inclined surface, and push button 67 of talking mechanism 59 is arranged in the path of rearward movement of edge 75 when housing 18 is moved from its normal position, shown in broken lines, to the position shown in full lines. During this movement, edge 75 depresses push button 67 to actuate the talking mechanism. No relative movement takes place between pawl 70 and arm 28 because of the engagement of finger 73 against stop 74. Upon the return movement of housing 18 to its broken line position, the front edge 76 of pawl 70 strikes push button 67 and is pivoted in a counterclockwise direction against the force of spring 72. As a result, push button 67 is not again depressed during this return movement.

It is contemplated that a number of children will play with the toy simultaneously. Each child is randomly given a designation, such as queen, duchess, princess, etc. This may be done by dealing cards to them, each card bearing a different designation. The children then use the play cosmetics, hair ornaments, etc. to beautify themselves, using the mirror 21. The mirror will reflect since light bulb 26 is off. Each groove of the talking mechanism record bears a different message such as "The queen is the fairest one" or "The duchess is the fairest one." When the children are ready, one asks the mirror who is the fairest. The mirror is then tilted to turn bulb 26 on and illuminate the face 25 which can be seen through the mirror. Simultaneously, push button 67 is depressed to randomly play the message in one of the grooves, which tells one of the players that she is the fairest one.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A sound-producing mirror toy, comprising:

(a) a base, (b) a housing movably mounted on said base, (c) a mirror comprising one wall of said housing, said mirror being of the type which reflects light from its front surface when there is darkness behind it and which becomes transparent when there is light behind it, said mirror comprising a transparent sheet carrying a metal coating, and said mirror being planar so that it faithfully reflects the image of a person looking at it, (d) a representation within said housing behind said mirror, (e) a light source within said housing behind said mirror, (f) an electrical sound-producing mechanism, and (g) means for simultaneously energizing said light source, to make said representation visible through said mirror, and for actuating said sound producing mechanism.

2. A sound-producing mirror toy as defined in claim 1 wherein said mirror comprises a metallized sheet of plastic.

3. A sound-producing mirror toy as defined in claim 1 wherein said representation is three dimensional and is spaced from said mirror.

4. A sound-producing mirror toy, comprising:

a base, two upstanding posts on said base, a housing pivotally supported between the upper ends of said posts, a representation of a face within said housing, a light source within said housing, a mirror on the front of said housing of the type which reflects light from its front surface when the interior of the housing is dark and through which said representation is visible when said light source is energized, a talking mechanism within said base capable of producing a plurality of spoken messages, a push button on said talking mechanism which each time it is depressed causes a randomly selected one of said spoken messages to be produced, a power source within said housing, switch means between said power source and said light source, and means carried by said housing and responsive to pivotal movement thereof for simultaneously closing said switch to energize said light source and for depressing said push button to cause a spoken message to be produced.

5. A sound-producing mirror toy, comprising:

(a) a base, (b) a housing movably mounted on said base, (c) a mirror comprising one wall of said housing, said mirror being of the type which reflects light from its front surface when there is darkness behind it and which becomes transparent when there is light behind it, (d) a representation within said housing behind said mirror, (e) a light source within said housing behind said mirror, (f) an electrical sound-producing mechanism, and (g) means responsive to movement of said housing with respect to said base for simultaneously energizing said light source, to make said representation visible through said mirror, and for actuating said sound producing mechanism.

6. A sound-producing mirror toy as defined in claim 5 including a power source, at least one switch means between said power source and said light source, said switch means having cooperable stationary and movable contacts, said movable contact being movable, in response to movement of said housing, for closing and opening said switch means to energize and deenergize said light source.

7. A sound-producing mirror toy as defined in claim 6 wherein one of said stationary and movable contacts is resilient, the other of said contacts stressing said resilient contact when said housing is moved to close said switch means, said resilient contact serving to return said housing to its initial position in which said switch means is open.

8. A sound-producing mirror toy as defined in claim 6 wherein said stationary contact is resilient, and said movable contact is carried by a support member projecting from said housing and having an inclined surface, said inclined surface engaging and stressing said stationary contact when said housing is moved to close said switch means and said stationary contact reacting against said inclined surface to return said housing to its initial position in which said switch means is open.

9. A sound-producing mirror toy as defined in claim 5 wherein said sound-producing mechanism includes means for producing a plurality of spoken messages, and actuator means responsive to movement of said mirror for causing a randomly-selected one of said spoken messages to be produced.

10. A sound-producing mirror toy as defined in claim 5 wherein said sound-producing mechanism includes a push button which when depressed causes sounds to be produced, and actuator means movable in response to movement of said housing for depressing said push button.

11. A sound-producing mirror toy as defined in claim 10 wherein said actuator means includes an arm projecting from said housing, and a pawl pivotally mounted on said arm, said push button being in the path of movement of said pawl when said housing is moved, abutment means for preventing pivotal movement of said pawl with respect to said arm when said housing is moved in one direction, to engage said push button, so that said push button is depressed, said pawl being pivotable with respect to said arm when it engages said push button upon movement of said housing in the opposite direction, so that said push button is not depressed.

* * * * *